United States Patent [19]

Nehrig

[11] 4,078,383

[45] Mar. 14, 1978

[54] HYDRAULIC HAND JACK WITH NEEDLE RELEASE VALVE

[75] Inventor: R. Harlan Nehrig, Stevensville, Mich.

[73] Assignee: Auto Specialties Manufacturing Company, St. Joseph, Mich.

[21] Appl. No.: 756,729

[22] Filed: Jan. 4, 1977

[51] Int. Cl.[2] ..... F15B 15/18; B66F 3/24

[52] U.S. Cl. ..... 60/477; 60/481; 251/122; 254/93 H

[58] Field of Search ..... 60/477, 481, 482, 458; 254/93 H, 93 R; 251/122, 208; 137/454.5

[56] References Cited

U.S. PATENT DOCUMENTS

| | | | |
|---|---|---|---|
| 2,527,841 | 10/1950 | Mueller | 254/93 H |
| 2,548,902 | 4/1951 | Mueller | 60/481 |
| 2,739,808 | 3/1956 | Carlson | 60/477 X |
| 2,822,789 | 2/1958 | Philips et al. | 251/122 X |

*Primary Examiner*—Edgar W. Geoghegan
*Attorney, Agent, or Firm*—Olson, Trexler, Wolters, Bushnell & Fosse, Ltd.

[57] ABSTRACT

A hydraulic vehicle jack including a novel release valve is disclosed. The jack is of the type having a high pressure cylinder, a ram partially extensible from and retractable into the cylinder, and a high pressure pump for forcing fluid from a reservoir into the cylinder to extend the jack. When it is desired to lower the jack, the release valve needle is turned so as to withdraw a needle tip from fluid-flow-halting engagement with a valve seat. This needle tip is formed in the shape of a cone having an altitude of a dimension greater than the cone base radius. When the needle tip is withdrawn from its position against the valve seat, a small but precisely defined fluid-flow-permitting orifice is created. Valve lowering action then occurs over an extended time period which permits the jack operator to precisely control or halt valve lowering action as desired.

6 Claims, 4 Drawing Figures

HYDRAULIC HAND JACK WITH NEEDLE RELEASE VALVE

BACKGROUND OF THE INVENTION

This invention relates generally to hydraulic jacks, and more particularly concerns a valve for closely controlling the release of pressure within the hydraulic jack.

Hydraulic jacks such as those disclosed in U.S. Pat. Nos. 2,548,902 and 2,548,903 have met with great success in commercial marketplaces. They are compact, safe, relatively lightweight, and can lift heavy loads without excessive exertion by the jack user.

When the user of the disclosed or somewhat similar jacks wishes to lower a jack-elevated load, he operates a release valve. Commonly such a release valve includes a needle valve stem which can be screwed toward and away from a valve seat to correspondingly close or open the valve, and which consequently halts or permits jack-lowering fluid flow.

When the jack is extended and is supporting a heavy load, the fluid pressures experienced by this release valve can be high. Inattentive operation of the valve can result in the jack-supported load being lowered somewhat more rapidly than the jack user may anticipate. In other instances, it may be desireable to lower the supported load at a predetermined rate, or to halt the load-lowering action at a given point. Previously offered release valves have not been adapted to perform such operations precisely.

It is accordingly the general object of the present invention to provide a hydraulic jack having an improved release valve for jack lowering operations. More specifically, it is an object to provide a release valve which provides relatively precise control of the jack lowering operations.

Yet another object is to provide a jack having a precise release valve which is reliable and rugged in operation, and which provides relatively long service life.

Other objects and advantages of the invention will become apparent upon reading the following detailed description and upon reference to the drawings. Throughout the drawings, like reference numerals refer to like parts.

DETAILED DESCRIPTION

While the invention will be described in connection with a preferred embodiment, it will be understood that it is not intended to limit the invention to this embodiment. On the contrary, it is intended to cover all alternatives, modifications and equivalents as may be included within the spirit and scope of the invention as defined by the appended claims.

Figure 1:
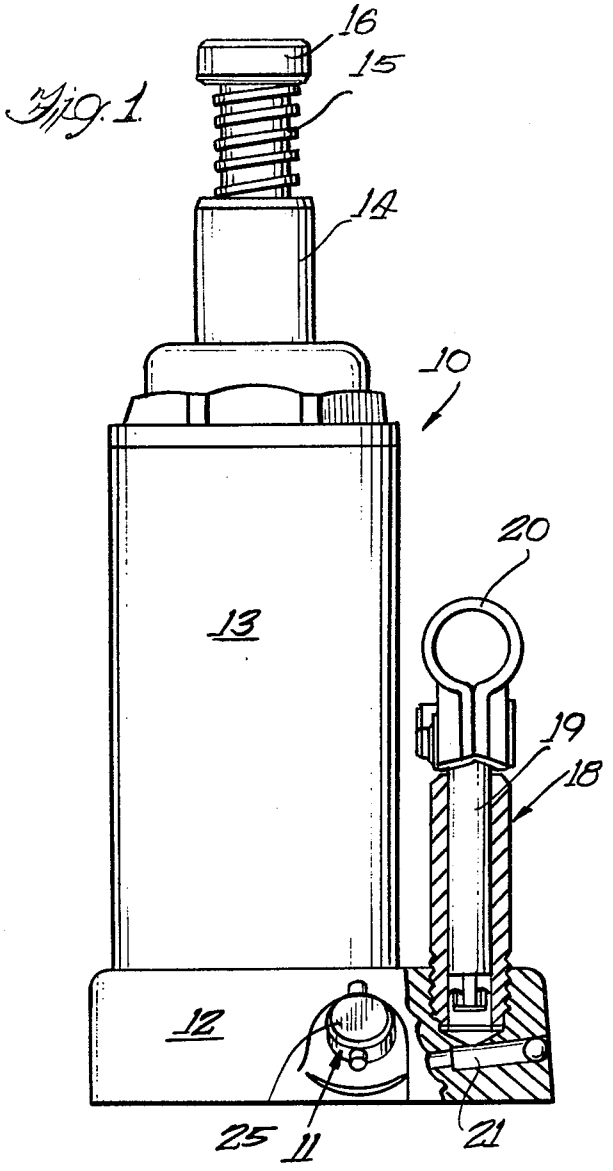
FIG. 1 is a side elevational view of a jack utilizing the present invention showing a jack operating pump and a portion of the jack bore in cut-away format.

Turning first to FIG. 1, there is shown a hydraulic jack 10 utilizing a novel release valve 11 embodying the present invention. In general, this jack 10 includes a base member 12 and an upstanding sleeve member 13. Within the sleeve member 13 is a cylinder (not shown) from which extends a ram rod 14. The range of heights through which the jack can operate is adjusted by a screw extension 15 threaded into the ram rod 14; the extension 15 terminates in a load-engaging pad 16.

To extend the ram rod 14 and consequently elevate an engaged load, a high pressure pump 18 is secured in and on the base. A pump piston 19, reciprocated by an attached socket 20, forces hydraulic fluid through a communicating passage 21 and other passages into a ram-elevating chamber (not shown).

Figure 2:
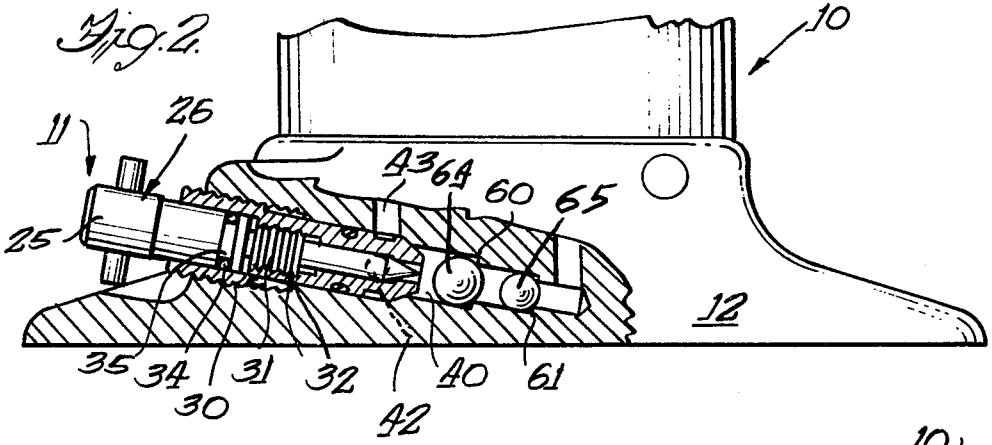
FIG. 2 is a fragmentary view of the jack base showing, in cut-away format, a novel release valve as it appears in a valve-closed position.
Figure 3:
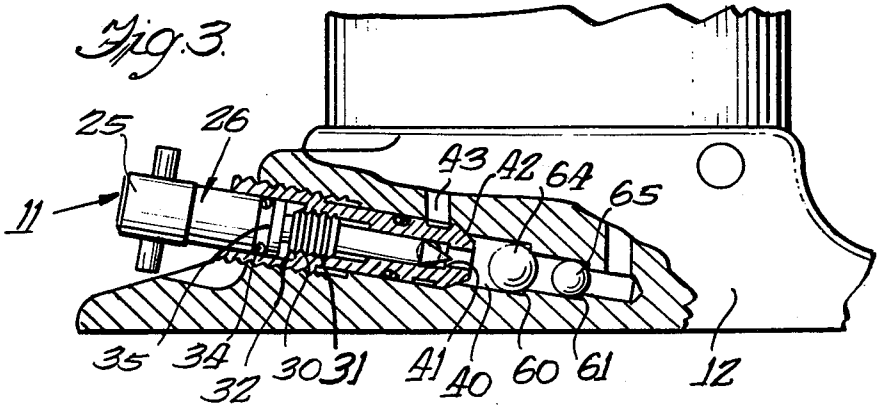
FIG. 3 is a fragmentary view similar to FIG. 2, but showing the valve as it appears in the valve-open position.

When it is desired to lower the ram rod 14 and load-supporting pad 16, the release valve is operated by appropriately rotating the head 25 of the valve needle 26. Here, this valve needle or release 26 is contained in an insert 30 screwed into the base 12. As shown in FIGS. 2 and 3, appropriate rotation of the needle 26 withdraws the needle from the closed position shown in FIG. 2 to the open position shown in FIG. 3 and permits consequent fluid flow so as to permit jack lowering action. This needle removal and insertive motion is here caused by mating insert and needle threads 31 and 32. An O-ring 34, carried in a recess 35, prevents fluid leakage along the needle member 26 itself. As the needle 26 is withdrawn from its closed position shown in FIG. 2 to its open position shown in FIG. 3, fluid flow is permitted from a forechamber 40 through an axially oriented passage 41, through ports 42, and thence out an exhaust passage 43 to the reservoir (not shown).

Figure 4:
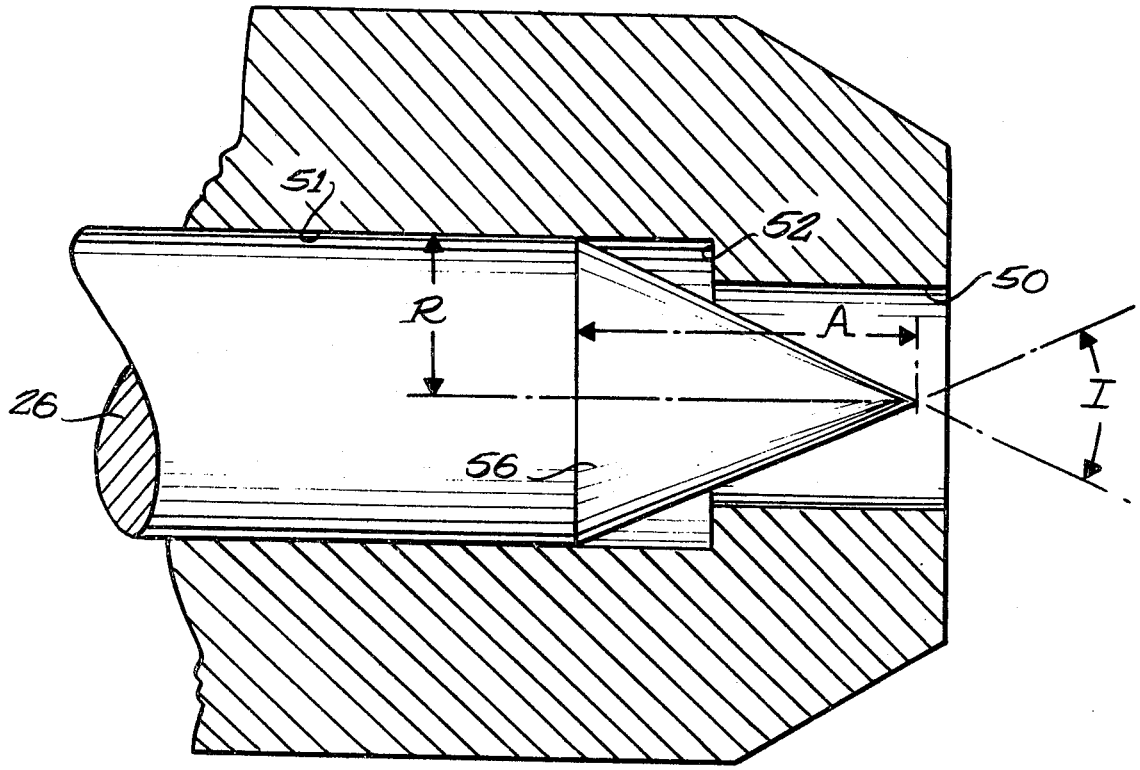
FIG. 4 is a fragmentary view showing in an enlarged format the valve needle and associated valve seat shown in FIGS. 2 and 3.

In accordance with the invention, this novel needle valve permits relatively precise control of fluid flow and consequently precise control of jack load-lowering action. To this end, a fluid passage is defined, as is shown in FIG. 4, by a bore 50 of relatively small diameter and a bore 51 of relatively large diameter located axially adjacent the small bore 50. Together, these bores 50 and 51 define an abrupt valve seat orifice shoulder 52 of relatively small axial extent. Cooperating with this orifice-defining shoulder 52 is the needle 26 which terminates in a cone-like tip 56. To gradually withdraw this surface 56 from the mating shoulder 52 in a precisely controlled manner, and to consequently provide a fluid-flow-permitting orifice of precisely controlled size, the needle cone tip surface 56 can be considered to be described by a geometric cone having an altitude A of greater dimension than the maximum cone radius R, as shown in FIG. 4. Practical experience has shown that a needle formed with a cone tip having an included angle I of between 25° and 45° provides desirable fluid flow control when the valve stem and insert are formed with commonly available mating threads, such as those formed to the National United Fine Screw Thread Specification Standards of the American Standards Association, Class 2 Fit, 28 turns per inch.

It is a feature of the invention that this valve can be effectively used with additional valve mechanisms to provide precise overall control of the jack positioning and lifting capabilities. Here, two additional valve-seat defining shoulders 60 and 61 are spaced axially from the first seat shoulder 52. Associated with each shoulder 60 and 61 is a check ball 64 and 65, respectively. Fluid pressure against these balls causes them to move toward and away from the associated shoulder seats to selectively halt and permit fluid flow through the ball-seat valve when the high pressure pump 18 is operated.

In using valve arrangements of the type described, it has been found that the time during which a given load will be lowered on the jack from the jack fully extended position to the fully descended position can be materially extended for given amounts of valve head turning and consequent valve opening. For example, a 3,000 pound dead weight can be placed upon the fully extended jack 10. When the release valve head 25 is open one-quarter turn, the load can, under some conditions, drop from the jack fully-extended position to the jack fully-retracted position in about one-half second. When, however, the same test is run with a jack utilizing the novel release valve and needle described and claimed herein, the load drop time can be expected to be extended to three to five seconds. The extended duration of this drop action permits the jack user to maintain precise control over the dropping action. Under these conditions, the dropping action can be speeded up, slowed down, or even halted by appropriate valve head rotation.

The invention is claimed as follows:

1. A hydraulic vehicle jack comprising, in combination, a hydraulic fluid reservoir, a high pressure cylinder, a ram partially extensible from and retractable into the cylinder, a high pressure pump in fluid communication with the reservoir and with the cylinder to force fluid from the reservoir under high pressure into the cylinder to extend the ram, and a shiftable release valve for controlling fluid flow from the high pressure cylinder back to the reservoir, the valve comprising an insert defining a fluid passage between the chamber and the reservoir and a valve seat defined in the passage, and a release needle carried axially in the insert by mating insert and needle threads for screw motion toward and away from a valve seat, the needle including a seat-engaging surface, the surface being described by a geometric cone having an altitude of greater dimension than the maximum cone radius, whereby to provide precise control of fluid flow through the annular orifice created between the valve conical surface and the insert seat as the valve is opened.

2. A jack according to claim 1 wherein said valve insert passage includes a bore of relatively small diameter and a co-centered but axially adjacent bore of relatively large diameter, the bores thus defining an abrupt valve shoulder seat of relatively small axial extent, whereby to provide precise control of fluid flow through the annular orifice created when the needle cone is withdrawn from contact with the shoulder.

3. A shiftable release valve according to claim 2 wherein said jack includes at least two additional valve seat-defining shoulders spaced axially from the first valve seat shoulder, and wherein the jack further includes at least one check ball associated with each additional seat and moveable toward and away from fluid flow sealing engagement with the associated seat to selectively halt and permit fluid flow through a ball-seat orifice.

4. A shiftable release valve according to claim 1 wherein the included angle defining the point of said needle cone generator is between 25° and 45°.

5. A hydraulic vehicle jack comprising, in combination, a hydraulic fluid reservoir, a high pressure cylinder, a ram partially extensible from and retractable into the cylinder, a high pressure pump in fluid communication with the reservoir and with the cylinder to force fluid from the reservoir under high pressure into the cylinder to extend the ram, and a shiftable valve for controlling liquid flow from a high pressure chamber to a reservoir, the valve including a fluid passage between the chamber and the reservoir, the passage being at least partly defined by a bore of relatively small diameter, a co-centered but axially adjacent bore of relatively large diameter, and an abrupt valve seat-defining annular shoulder between the bores, and a release needle axially shiftable in the large bore toward and away from the shoulder, the needle terminating in a shoulder-engaging surface described by a geometric cone having an altitude of greater dimension than the maximum cone radius, whereby to provide precise control of a fluid flow through an annular orifice created between the needle cone and the passage seat shoulder by axial withdrawal of the needle from the shoulder.

6. A shiftable release valve according to claim 5 wherein said needle cone generator is defined by an included tip of substantially 40°.

* * * * *